US006308720B1

(12) United States Patent
Modi

(10) Patent No.: US 6,308,720 B1
(45) Date of Patent: Oct. 30, 2001

(54) METHOD FOR PRECISION-CLEANING PROPELLANT TANKS

(75) Inventor: Paresh R. Modi, Highlands Ranch, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/289,372

(22) Filed: Apr. 8, 1999

Related U.S. Application Data

(60) Provisional application No. 60/081,099, filed on Apr. 8, 1998.

(51) Int. Cl.[7] ..... B08B 9/093; B08B 9/46

(52) U.S. Cl. ..... 134/22.1; 134/22.19; 134/26; 134/29

(58) Field of Search ..... 134/22.14, 22.19, 134/26, 40, 29, 22.1, 27

(56) References Cited

U.S. PATENT DOCUMENTS

| | | | | |
|---|---|---|---|---|
| 2,023,496 | | 12/1935 | Todd . | |
| 4,380,268 | | 4/1983 | Martin | 166/304 |
| 5,047,083 | * | 9/1991 | Blake et al. | 134/2 |
| 5,232,514 | | 8/1993 | Van Sciver et al. | 134/26 |
| 5,375,378 | | 12/1994 | Rooney | 451/38 |
| 5,427,709 | | 6/1995 | Antin et al. | 252/135 |
| 5,520,837 | | 5/1996 | Antin et al. | 252/135 |
| 5,700,523 | | 12/1997 | Petrole et al. | 427/397.8 |
| 6,016,820 | * | 1/2000 | Knoll et al. | 134/95.1 |

OTHER PUBLICATIONS

Dupont, "Vertel MCA Cleaning Agent" 1/98.

* cited by examiner

*Primary Examiner*—Randy Gulakowski
*Assistant Examiner*—Saeed Chaudhry
(74) *Attorney, Agent, or Firm*—Marsh, Fischmann & Breyfogle LLP

(57) ABSTRACT

A method for precision-cleaning the aluminum alloy inner wall surface of a tank is disclosed. In one embodiment, the inner wall surface is cleaned by a method including the steps of washing the inner wall surface with a first portion of water, applying an aqueous cleaning solution comprising sodium silicate, sodium tetrafluoroborate and sodium molybdate, and rinsing the inner wall surface with a second portion of water. In a second embodiment, the method is directed to precision-cleaning a launch vehicle booster propellant tank. In this embodiment, the method includes the steps of applying washes of water and aqueous cleaning solution on at least upper and lower sections of the inner wall surface of the tank, washing such sections with water, and analyzing samples of effluent cleaning solution and water collected from the effluent drain of the tank for hydrocarbon and particulate contaminants. In a third embodiment, the method further includes drying the tank and verification of hydrocarbons and nonvolatile residues and then further drying the tank to the system level requirement.

35 Claims, 8 Drawing Sheets

METHOD FOR PRECISION-CLEANING PROPELLANT TANKS

RELATED APPLICATION

This application claims the benefit of U.S. Provisional Application No. 60/081,099 filed Apr. 8, 1998.

FIELD OF THE INVENTION

The present invention relates generally to methods for cleaning metallic material surfaces and, more specifically, to a method for precision-cleaning the inner wall surfaces of large containers such as aluminum alloy launch vehicle booster propellant tanks with complex isogrid structured inner wall surfaces.

BACKGROUND OF THE INVENTION

The cleaning of structures having metallic surfaces can often pose various challenges. This is especially the case after fabrication, when complex residues may be found on the surfaces of the structure. Such residues may contain, for example, macroscopic and microscopic metallic particles produced by cutting and smoothing processes during fabrication; organic oils, greases and other lubricants used during fabrication; various fibers from fabrics used in initial cleaning and handling of the structure; and microscopic particles and fibers from the environment. These residues are often a combination of materials. Particulate residues embedded in heavy organic greases usually cannot be removed by washing with water because water will not dissolve or displace the grease. Some solvents that dissolve or displace the residues are generally either too expensive to apply on a large scale or they are a threat to the environment, such as ozone depleting chemicals.

Further, the cleaning of the interior wall surfaces of large container structures can be challenging, especially when it is necessary to precision-clean such surfaces, i.e. to remove not only macroscopic quantities of metal particles, hydrocarbons, and other residues, but also microscopic quantities of such residues. This is the case with the booster tanks of space launch vehicle booster propellant tanks. The inner wall surfaces of such tanks may not to be smooth surfaces. Instead, in some instances, the inner wall surfaces of launch vehicle propellant tanks are complex, having a multiplicity of ridges and test components that extend radially inwardly away from the walls into the internal containment area of the tank, and that may abut or intersect to form corners. Particles and organic residues remaining after the launch vehicle propellant tank fabrication process may adhere to and become lodged against these ridges and components and the corners formed by them, making cleaning difficult. The inner wall surfaces of launch vehicle propellant tanks having an isogrid structure are especially prone to this problem. Such tanks may be fabricated from aluminum panels. Achieving an isogrid structure (e.g., for lightweight and structural strength considerations) on the inner wall surfaces of the panels may involve a process of "hogging out" large quantities of aluminum, leaving numerous large and small aluminum particles on the panels. In addition, the process of hogging out the panels may employ various organic lubricating oils and greases, such that residues of these materials are also left on the inner wall surfaces of the panels making up the launch vehicle propellant tank. Wiping the inner wall surfaces with solvent dampened fabrics removes a significant quantity of these residues. Yet, such physical methods of cleaning are generally not sufficient to precision-clean the surfaces to be substantially free of macroscopic and microscopic residues and are not practical to clean large structures like launch vehicle tanks. In addition, the common practice of physically wiping the inner wall surfaces of launch vehicle propellant tanks may leave behind fibers from the fabric cloth or pad used to wipe the panels. The presence of even small quantities of such residues can cause a fire hazard when the launch vehicle propellant tanks are filled with liquid oxygen. Also, such residues can cause degradation in the performance of the propellants so affecting the efficiency of the launch vehicle's rocket engine.

SUMMARY OF THE INVENTION

An object of the present invention is to provide a method for precision-cleaning the inner wall metallic material surfaces of large containers (e.g., aluminum alloy launch vehicle propellant tanks).

A further object of the present invention is to provide a method for removing particulates (e.g., particles and fibers, etc.) and organic residue from complex isogrid surfaces comprising a metallic material, such as aluminum alloy.

The present invention achieves one or more of these objectives by providing a method for removing particulate and organic residue from complex surfaces of large structures such as launch vehicle propellant tanks. More specifically, the method of the present invention generally includes the step of applying an aqueous cleaning solution comprising sodium silicate, sodium tetrafluoroborate, and sodium molybdate to the aluminum alloy inner wall surfaces of large structures, such as launch vehicle propellant tanks, to displace and disperse aluminum particles and other particulate and organic residue that may adhere to such surfaces. Utilization of this particular aqueous cleaning solution results in a substantially particulate and residue free inner wall surface. In one embodiment, the method of the present invention includes the steps of applying the aqueous cleaning solution to the aluminum alloy inner wall surface of a launch vehicle propellant tank to remove contaminants by displacement and rinsing the inner wall surface with water to further remove the used cleaning solution with suspended contaminants. For purposes of further enhancing the cleaning process, the method of the present invention may include, prior to the step of applying the aqueous cleaning solution, the step of applying the water to the inner wall surface of the tank to wash the inner wall surface. This step of applying the water wets the inner wall surface, removes gross contaminants such as aluminum particles, and inhibits drying of the cleaning solution during the subsequent applying the aqueous cleaning solution step. In order to enhance the cleaning process, the method may further comprise the step of selecting water to be used in the applying water step having a purity better than the desired cleanliness of the surfaces to be cleaned. Such purity may be achieved by a variety of methods such as filtration or deionization.

In another embodiment, the method of the present invention includes the steps of applying an aqueous cleaning solution comprising sodium silicate, sodium tetrafluoroborate, and sodium molybdate to an aluminum-containing inner wall surface of a tank to wet, loosen, and then displace contaminants, rinsing the inner wall surface with the water to further remove the used cleaning solution with suspended contaminants, and testing the resulting effluent cleaning solution for an indication of hydrocarbon contaminants and testing the resulting effluent rinse water for particulate contaminants, and residual cleaning solution to determine the efficacy of the cleaning process. In one embodiment, the step of testing is conducted after the step of applying the aqueous cleaning solution to determine whether the level of hydrocarbon contaminants in the effluent cleaning solution is excessive (e.g., above a first acceptable level of hydrocarbon contaminants). In another embodiment, the step of testing is conducted after the step of rinsing the inner wall surface with the water to determine whether the level of particulate contaminants and residual cleaning solution in the effluent rinsing solution is excessive (e.g., above a first acceptable level of particulate contaminants and above a first acceptable level of residual cleaning solution). In the event these testing steps indicate the presence of contaminants and/or residual cleaning solution above acceptable levels, then the method of the present invention contemplates repeating the applying and/or rinsing steps.

In a further embodiment of the invention, the method includes the steps of sequentially applying the above-noted cleaning solution and the water rinsing to at least upper and lower sections of the inner wall surface of a vertically oriented tank (e.g., launch vehicle propellant tank). In this embodiment, application(s) of the cleaning solution and the water rinse(s) are applied sequentially to these sections of the inner wall surface of the tank to inhibit drying of the cleaning solution, which may gel, trapping contaminants on the inner wall surface, and to enhance displacement and removal of organic and particulate contaminants. This embodiment of the method of the present invention may also include the above-noted testing steps after the steps of applying the cleaning solution and rinsing with the water to determine whether it is necessary to repeat these steps to achieve a clean inner wall surface of the tank. The method of the present invention may also be used to precision clean horizontally oriented or angled tanks (e.g., launch vehicle propellant tanks), depending upon the location of the drain opening of the tank.

The method of the present invention is a highly effective approach to precision-cleaning a complex metallic material surface, e.g., aluminum alloy surface. The method is particularly advantageous when used to clean the inner wall surfaces of launch vehicle booster propellant tanks intended for use with liquid oxygen and rocket propellant fuel. This is because the method can be applied to substantially remove macroscopic and microscopic particulates, e.g., metallic particles such as aluminum particles and hydrocarbon residues that may remain after fabrication and which would otherwise present a fire hazard when in contact with liquid oxygen and rocket propellant fuel.

It should be noted that the acqueous cleaning solution may be recycled after each use and prior to supplying the solution for use in the cleaning process from a storage vessel or tank, the stored solution may be filtered. Further, equipment, tools, fixtures, pumps, valves, tubes, hoses, etc., are to be compatible with the acqueous cleaning solution, water, liquid oxygen and the rocket propellant fuel.

DETAILED DESCRIPTION

Figure 1:
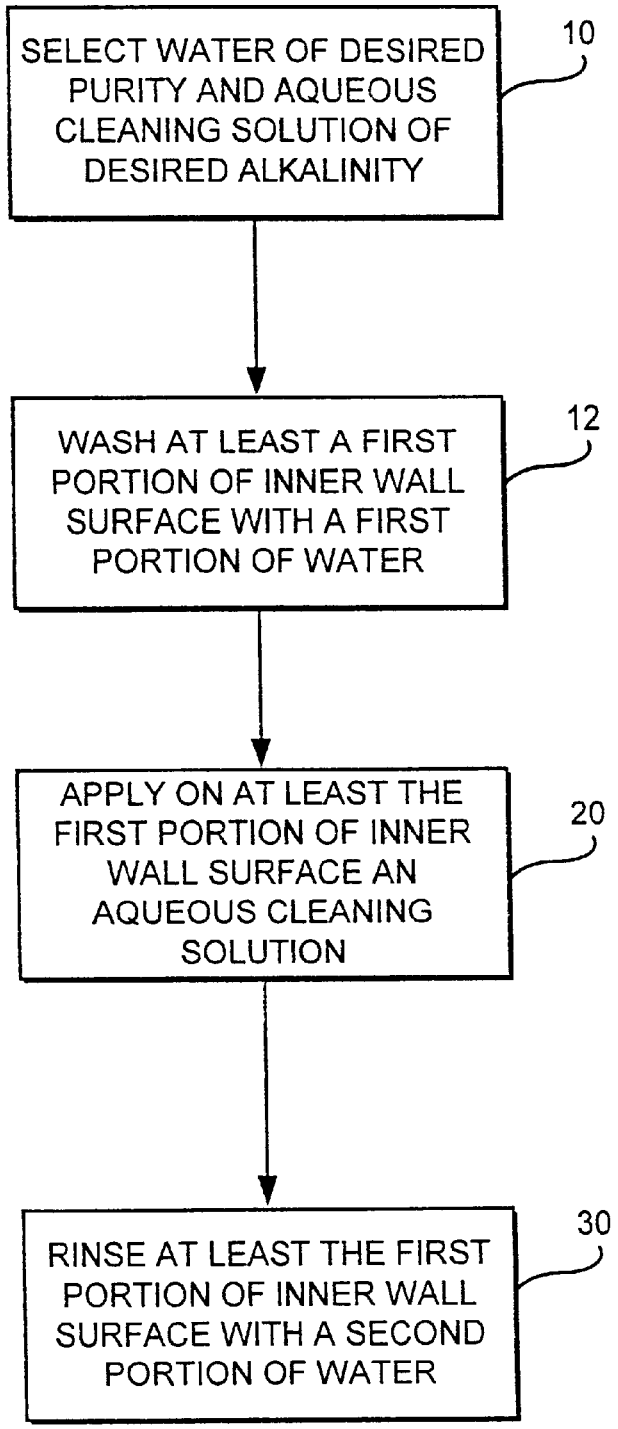
FIG. 1 is a flow chart of one embodiment of the method of the present invention for precision-cleaning the inner wall surface of a tank.

In the following description, the invention is set forth in the context of precision-cleaning the interior walls and test components of large space launch vehicle booster propellant tanks. The embodiment described herein is utilized with booster tanks of two varieties, the liquid oxygen (LOX) oxidizer tank, 13 feet in diameter and 58 feet in height, with a capacity of approximately 50,000 gallons, and the rocket propellant (RP) fuel tank, 13 feet in diameter and 32 feet in height, with a capacity of approximately 26,000 gallons. The inner wall surface of each tank forms an internal containment area which functions to hold liquid oxygen or rocket propellant fuel. Each tank has an aft and a forward dome, and test components attached to the inner wall surfaces. When the tank is vertically aligned, the forward dome is located on the top end of the tank and the aft dome is located on the bottom end of the tank. The outlet sump welded to the aft dome has a drain opening. The forward dome has a manhole and manhole cover. The tanks are comprised of barrel panels. In one embodiment, aluminum alloys used in the fabrication of the tank are of the 2000, 6000 and 7000 series (e.g., 2014-T62, 2014-T651, 2219-T6 and 7050-T7451 for forward and aft domes, barrel panels, outlet sump and manhole cover, respectively). Further, the inner wall surface of the panels are machined in a "hogging out" process to form an isogrid structure on the inner walls of the panels, which can result in the deposit of aluminum alloy particles, organic residues, and other contaminants on the panels. Such particles and organic residues can cause a fire hazard if they are left in the booster tank when it is filled with liquid oxygen. Hydrocarbon residues are not compatible with liquid or gaseous oxygen and such residues and others can degrade performance of the launch vehicle propellants, affecting the efficiency of the rocket engine. Therefore, it is necessary to precision-clean the tanks to remove substantially all traces of such materials. It should be noted that, while the present embodiment is set forth in the context of launch vehicle booster tanks, having interior walls comprised of one or more aluminum alloys and barrel panels machined in an isogrid structure, the invention can be used with a wide variety of structures (e.g., tanks, containers, etc.) which have surfaces that are smooth or textured and which comprise other metallic materials compatible with the aqueous cleaning solution utilized in the method of the present invention and compatible with liquid oxygen and rocket propellant fuel. It should be noted that the method of the present invention can also be applied to cleaning other types of tanks and containers, such as tanks intended for containing helium having smaller dimensions (e.g., three feet in diameter and six feet in length) and surfaces fabricated of other aluminum alloys, such as the 6000 series of aluminum.

The present embodiment utilizes a cleaning solution comprising sodium silicate, sodium tetrafluoroborate, sodium molybdate and water to remove the hydrocarbon and particulate residues that remain on the inner wall surface of the booster tank following fabrication. The method generally includes the steps of applying a concentrated aqueous cleaning solution comprised of sodium silicate, sodium tetrafluoroborate, and sodium molybdate to the inner wall surface of a vertically-aligned tank, and rinsing the inner wall surface of the tank with water. The purity of water in steps of rinsing the inner wall surface with water, as discussed below, with reference to Tables 1 and 2, shall be better than the desired cleanliness of the tank. Application of the cleaning solution functions to wet, loosen, and then displace hydrocarbon residues and to dislodge aluminum particles embedded in such residues, forming an effluent cleaning solution that then drains down the inner wall surface of the tank. The step of rinsing the inner wall surface with the water generally functions to dilute, rinse and physically displace any remaining cleaning solution, hydrocarbon residues, and aluminum particles down the inner wall surface in an effluent rinse solution, towards the drain in the bottom of the tank. In a preferred embodiment, the rinsing step generally should occur no more than about five minutes after completion of the applying cleaning solution step to ensure that the aqueous cleaning solution remaining on the inner wall surface does not dry and form a film containing embedded contaminants on the inner wall surface. The method may further include a preliminary step of first washing the inner wall surface with a quantity of the water (e.g., filtered or deionized water, as required), before the step of applying cleaning solution. The purpose of this step is to wash gross aluminum particles, fibers, and other contaminants towards the drain, and to wet the inner wall surface. Wetting/moistening of the inner wall surface prior to the step of applying cleaning solution tends to reduce the likelihood that the cleaning solution will dry and form a film on the inner wall surface which contains or holds contaminants on the inner wall surface.

The method may also include one or more additional steps of testing the effluent cleaning solution and the effluent rinse solution. A first testing step may occur after the step of applying cleaning solution, which testing step includes analyzing the effluent cleaning solution for an indication of hydrocarbon contaminants. A second testing step may occur after the rinsing step; the second testing step includes analyzing the effluent rinse solution for the presence of particulate matter. If contaminants are still present in the effluent solutions, then the method may include repeating the steps of applying the cleaning solution and rinsing the inner wall surface with the water, and then further testing the effluent for the presence of contaminants to evaluate whether the tanks have been adequately cleaned. Because a concentrated quantity of cleaning solution is used, all steps of the above-described method may be carried out at room temperature, in the range of about 65 degrees Fahrenheit to about 75 degrees Fahrenheit. In this regard, the method of the present invention does not require the cleaning solution be at an elevated temperature when applied to the inner wall surface of the tank. In addition, the purity of the water used for the prerinsing and rinsing steps is to be better than the desired cleanliness of the tank. Such purity of water may be achieved by purification of source water as required, such as by filtration or deionization.

FIG. 1 is a flow chart of one embodiment of a method for precision-cleaning the inner wall surface of a tank (e.g., launch vehicle propellant tank). As noted in FIG. 1, one embodiment of the present invention includes a step 10 of selecting water having a desired purity level and an aqueous cleaning solution having a desired alkalinity. The embodiment includes the step 12 of washing at least a first portion of the inner wall surface of a tank with a first portion of the water. The step of washing may comprise rinsing (e.g., by spraying) at least the first portion of the inner wall surface of the tank with at least the first portion of the water. This generally will have the effect of dislodging and removing from the first portion of the inner wall surface gross contaminants such as macroscopic aluminum particles and fibers remaining after the fabrication process if such materials are not embedded in hydrocarbon contaminants. The process further includes the step 20 of applying on at least the first portion of the inner wall surface an aqueous cleaning solution comprising sodium silicate, sodium tetrafluoroborate, and sodium molybdate. Application (e.g., spraying) of the aqueous cleaning solution functions to dislodge and remove greases, oils and other hydrocarbon residues, while freeing aluminum and other particles trapped in such residues. The process further includes the step 30 of rinsing (e.g., spraying) the inner wall surface with a second portion of the water. The step 30 of rinsing with another portion of the water dilutes and substantially removes the aqueous cleaning solution remaining on the first portion of the inner wall surface and also substantially removes the dislodged contaminants. The step 30 of rinsing the inner wall surface with at least the second portion of the water may include the step of applying (e.g., spraying) at least the second portion of the water against at least the first portion of the inner wall surface.

FIGS. 2A–2D is a flow chart showing another embodiment of the method of the present invention, which is particularly useful in precision-cleaning large volume tanks, such as launch vehicle propellant tanks. The first step 110 of the method of the present invention includes positioning the tank on its aft (bottom) end, to vertically orient the tank. The tank has an inner wall surface with an upper section proximate to its forward (top) end and a lower section proximate to the tank's aft (bottom) end, the aft (bottom) end containing an effluent drain fixture. The method further includes the step 112 of pre-washing or rinsing the upper section of the inner wall surface of the tank with a first portion of the water and the step 114 of pre-washing or rinsing the lower section of the inner wall surface with a second portion of the water. The step 112 of pre-washing or rinsing comprises applying (e.g., spraying) the water against the upper section of the inner wall surface to dislodge and displace gross contaminants from the upper section of the inner wall surface, causing such gross contaminants to flow/wash downwardly, with the water stream along the inner wall surface towards the effluent drain. The step 114 of pre-washing or rinsing comprises applying (e.g., spraying) the water against the lower section of the inner wall surface to dislodge and displace contaminants on the lower section, and further causes such contaminants, along with contaminants washed from (e.g., flowing from) the upper section above, towards the effluent drain. The method further includes the step 120 of applying at least a first portion of aqueous cleaning solution, comprising sodium silicate, sodium tetrafluoroborate and sodium molybdate, on the lower section of the inner wall surface, which wets, loosens and then displaces hydrocarbon contaminants and particulate contaminants in the lower section. The step 120 of applying may comprise spraying at least the first portion of aqueous cleaning solution on the lower section of the inner wall surface. The step 122 of applying (e.g., spraying) at least a second portion of aqueous cleaning solution functions to remove hydrocarbon and particulate contaminants from the upper section of the inner wall surface, and results in the formation of an effluent cleaning solution of aqueous cleaning solution and contaminants which washes down over the lower section of the inner wall surface. Advantageously, this drainage of effluent cleaning solution maintains the wetness of the lower section of the inner wall surface of the tank, which inhibits the formation of a silicate film with contaminants trapped in it, and additionally has a further cleaning and washing effect on the lower section of the inner wall surface. The order of these steps in a large booster tank such as those used in the present embodiment is particularly advantageous because, as will be appreciated by those familiar with silicate solutions (e.g., such as the aqueous cleaning solution utilized in the method of the present invention), such solutions have a tendency under certain conditions to gel and dry into a silicate film. In the present invention, the formation of such a film could have a substantial detrimental effect on the cleaning process if formation of this film occurs before the contaminants are washed from the inner wall surface of the tank.

Referring to FIGS. 2A–2D, this embodiment of the method of the present invention further includes, following the step 122 of applying cleaning solution, a further step 124 of collecting at least a first sample of effluent cleaning solution from the effluent drain fixture of the tank and a step 126 of analyzing at least the first sample to determine whether the level of hydrocarbon contaminants are above a first acceptable level and/or are present in the effluent cleaning solution. If the step 126 of analyzing the first sample indicates that hydrocarbons are still present above the first level (e.g., following a "shake test," including agitating the effluent cleaning solution sample for at least about five seconds and allowing the solution sample to stand undisturbed for about five minutes, whereby no more than one layer of bubbles on the top layer of the effluent cleaning solution sample indicates an acceptable level of hydrocarbon contaminants), then the method includes repeating the steps of selecting the water of desired purity 111 and selecting cleaning solution 116, of pre-rinsing/washing the upper and lower sections of the inner wall surface 112, 114, applying another portion of the aqueous cleaning solution to the lower and upper sections of the inner wall surface 120, 122, collecting another sample of effluent cleaning solution 124 and analyzing the sample of effluent cleaning solution for hydrocarbon contaminants 126 until the level of hydrocarbon contaminants is negligible or below the first level. It should be noted that selecting the purity of the of the acqueous cleaning solution may be accomplished by an alkalinity test (e.g., that it is 10 ml to 30 ml of the acqueous cleaning solution). More specifically, the alkalinity test requires reagent preparation of 4% potassium biphtahalate (khp) solution in reagent water (4.0 grams khp/100 ml water) and 0.2% thymolphthalein in isopropyl alcohol (0.1 grams thymolphthalein/50 ml isopropyl alcohol). In 50 ml of khp solution add five drops of thymolphthalein solution, and then add acqueous cleaning solution until blue color end point persists for 15 seconds. The quantity of ml used is the alkalinity of the acqueous cleaning solution.

In this embodiment of the method of the present invention, when the level of hydrocarbon contaminants in the effluent cleaning solution is negligible, below the first level or are not otherwise present in the effluent cleaning solution, the method of the present invention further includes the step 130 of rinsing or washing the upper section of the inner wall surface with at least a third portion of the water to remove residual cleaning solution and particles which may be present on the upper section (e.g., from the above-described step 122 of applying the cleaning solution). The method further includes the steps 132 of collecting a sample of effluent water and 134 analyzing a sample of effluent water. If the analyzing step 134 indicates the residual cleaning solution remaining in the effluent water is above an acceptable level (e.g., having apH between about 6.5 and about 8.0), the step 130 of rinsing the upper section must be repeated before proceeding to the next step 138 of rinsing the lower section of the inner wall surface. If the level of cleaning solution is acceptable, the method then includes the step 138 of rinsing the lower section of the inner wall surface with at least a fourth portion of the water to remove residual cleaning solution and particles (e.g., from the above-described steps 120, 122 of applying the cleaning solution). Such rinsing steps 130, 138 result in the formation of an effluent water. As described in FIGS. 2C–2D, for purposes of determining whether there is an excessive amount of cleaning solution remaining on the inner wall surfaces of the tank, the method of the present invention further includes the step 140 of collecting at least a first sample of the effluent water following the rinsing step 138. The step 142 includes analyzing at least the first sample of effluent water for the presence of residual cleaning solution. If the level of cleaning solution is present above an acceptable level, the method includes repeating the rinsing step 138. If the level of cleaning solution is at an acceptable level, the method further comprises a final rinsing step 145 directed to the upper section only, followed by steps of collecting a sample of effluent water 146 and analysis of the sample of effluent water 147 for presence of particulate contaminants. The quantity of the final rinse shall be determined on the basis of 100 ml per square foot of internal surface area. The internal surface shall be rinsed with this pre-determined quantity of rinse water taking care to assure that all internal surfaces shall be adequately rinsed. If the level of particulate contaminants is above an acceptable level, the method further comprises repeating step 145 final rinse of the upper section of the inner wall surface. The particulate contaminants may include aluminum and other particles and fibers. The level of contaminant particles and fibers present in the effluent water ordinarily must meet an allowable distribution and weight of particles and fibers depending on the intended use of the system. For example, Tables 1 and 2 provide cleanliness standards applicable to certain launch vehicle applications, including an allowable distribution of particles and fibers.

TABLE 1

CLEANLINESS STANDARDS APPLICABLE IN CERTAIN AEROSPACE APPLICATIONS

| CLEANLINESS OF TANK PER APPLICABLE SYSTEM (E.G., LOX,RP-1,OR HELIUM OR OTHER) | PURITY OF RINSE WATER | PURITY QF NITROGEN GAS OR DRY AIR OR OTHER (INERT GAS) |
|---|---|---|
| NVR: 1.0 mg per 100 ml or per square foot (maximum) | Total Organic Carbon (TOC) <1.0 mg per 100 ml | — |
| Hydrocarbon: Maximum 10 parts per million by volume as Methane per liter | | Maximum 10 parts per million by volume as Methane per liter |
| Particles & Fibers: per 100 ml | <Required per 100 ml | <Required per 100 ml |

TABLE 1-continued

CLEANLINESS STANDARDS APPLICABLE IN CERTAIN AEROSPACE APPLICATIONS

| CLEANLINESS OF TANK PER APPLICABLE SYSTEM (E.G., LOX,RP-1,OR HELIUM OR OTHER) | PURITY OF RINSE WATER | PURITY QF NITROGEN GAS OR DRY AIR OR OTHER (INERT GAS) |
|---|---|---|
| (See attached table) | (See attached table) | (See attached table) |
| Total Filterable Solids (TFS) 0.10 mg per 100 ml or per square foot (maximum) | <0.10 mg per l00 ml | <0.10 mg per 100 m. |

ALLOWABLE DISTRIBUTION OF PARTICLES AND FIBERS

| SIZE RANGE MICRONS (Maximum Dimension of Particle or Fiber) | COUNT PER 100 ML OR $FT^2$ (Maximum Number Particles & Fiber) |
|---|---|
| <10 | Unlimited |
| 10 to 50 | 718 |
| >50 to 100 | 103 |
| >100 to 160 | 43 |
| >160 to 300 | 29 |
| >300 to 500 | 10 |
| >500 to 750 | 4 |
| >750 to 1000 | 1 |
| More than 1000 | 0 |

Figure 2A:
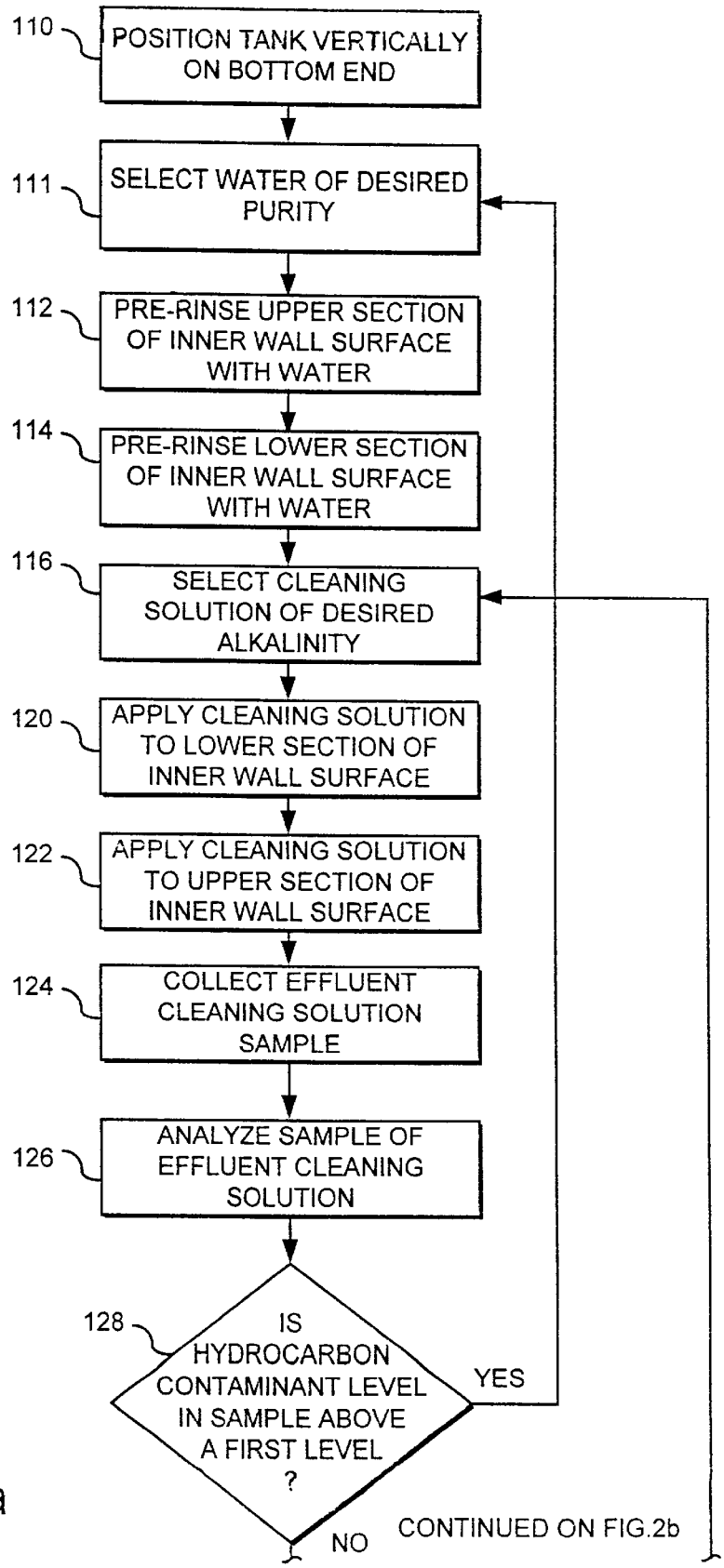
FIGS. 2A–2D is a flow chart of another embodiment of the method of the present invention for precision-cleaning the inner wall surface of a tank.
Figure 2B:
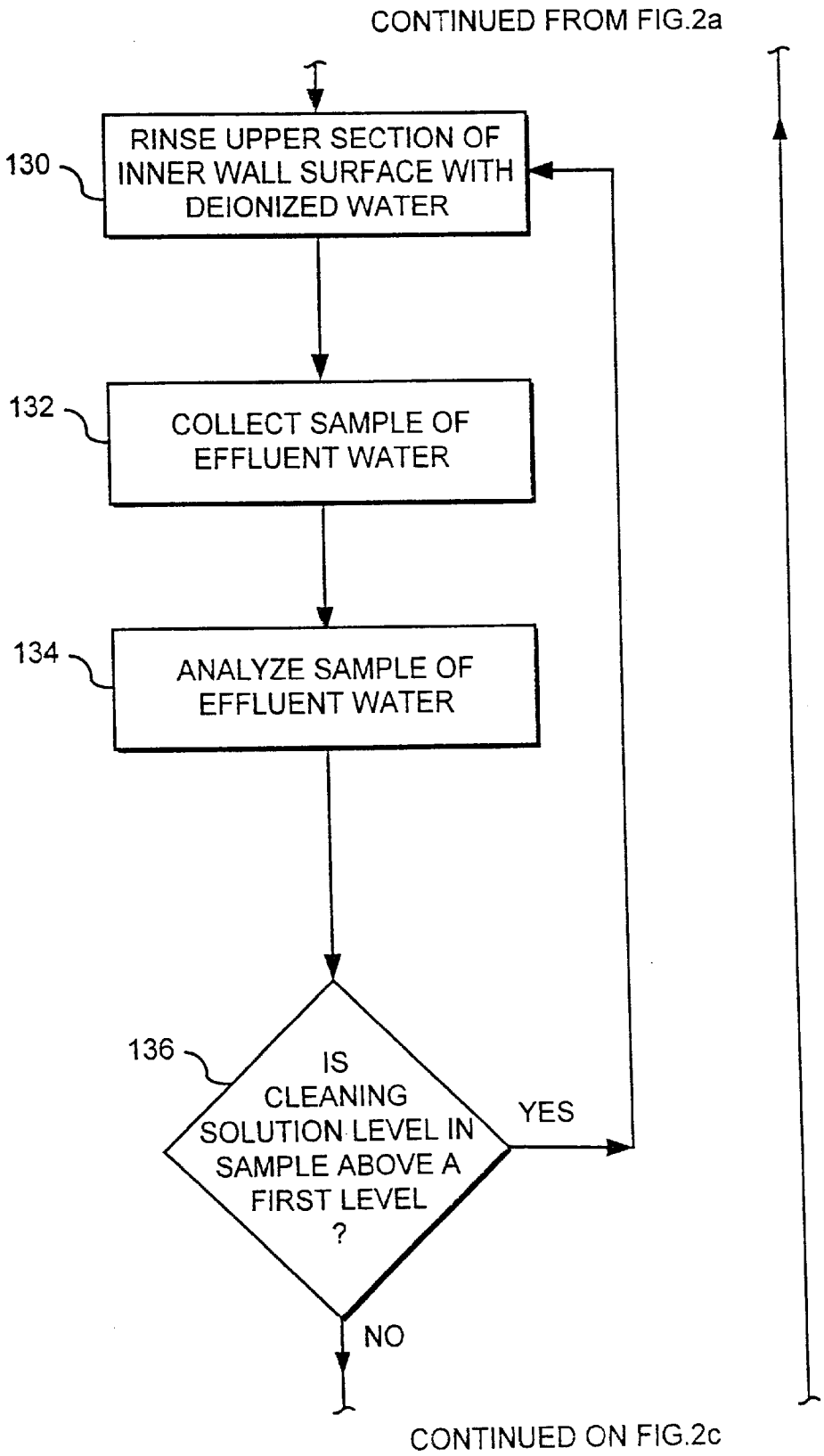
Figure 2C:
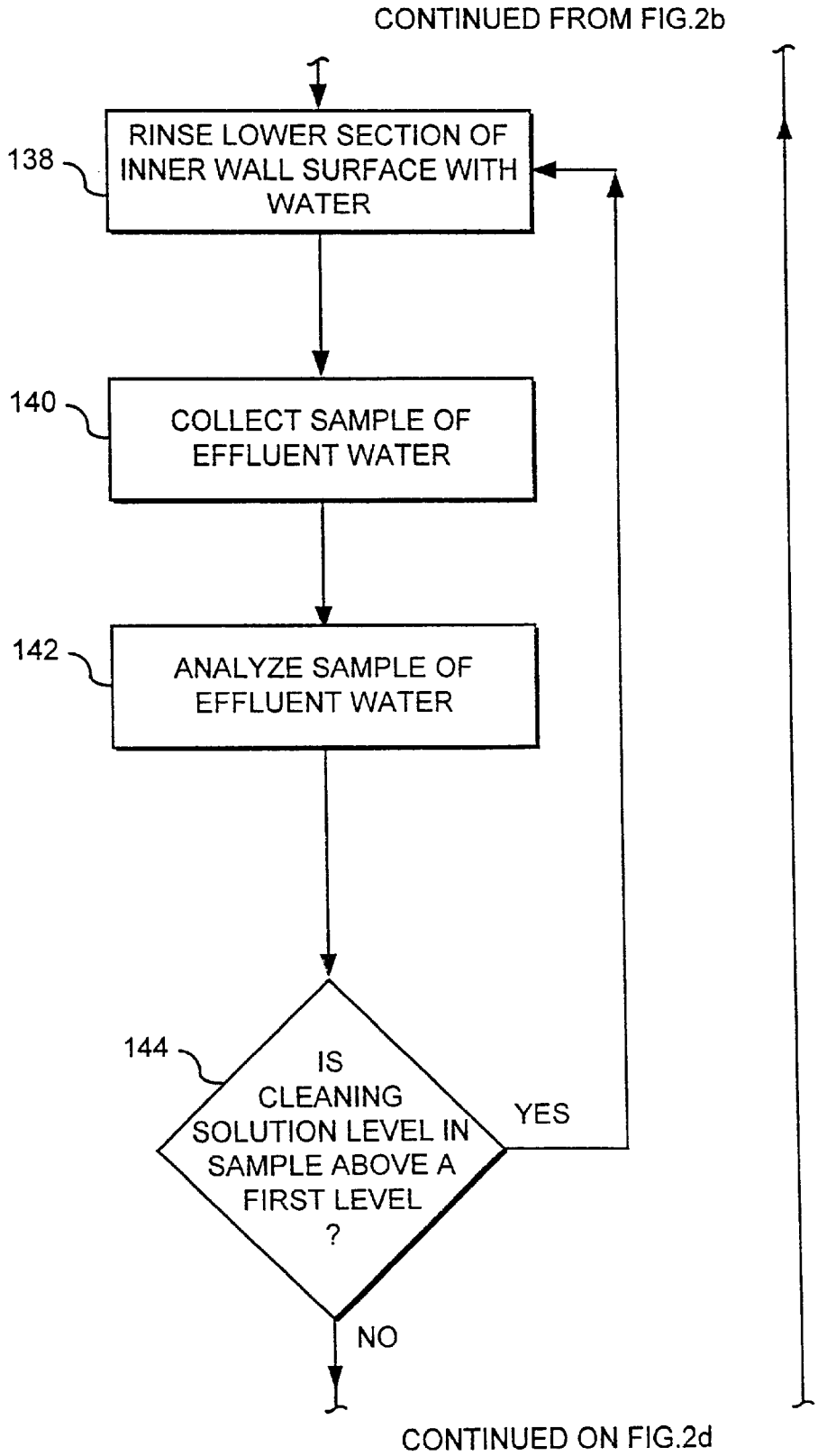
Figure 2D:
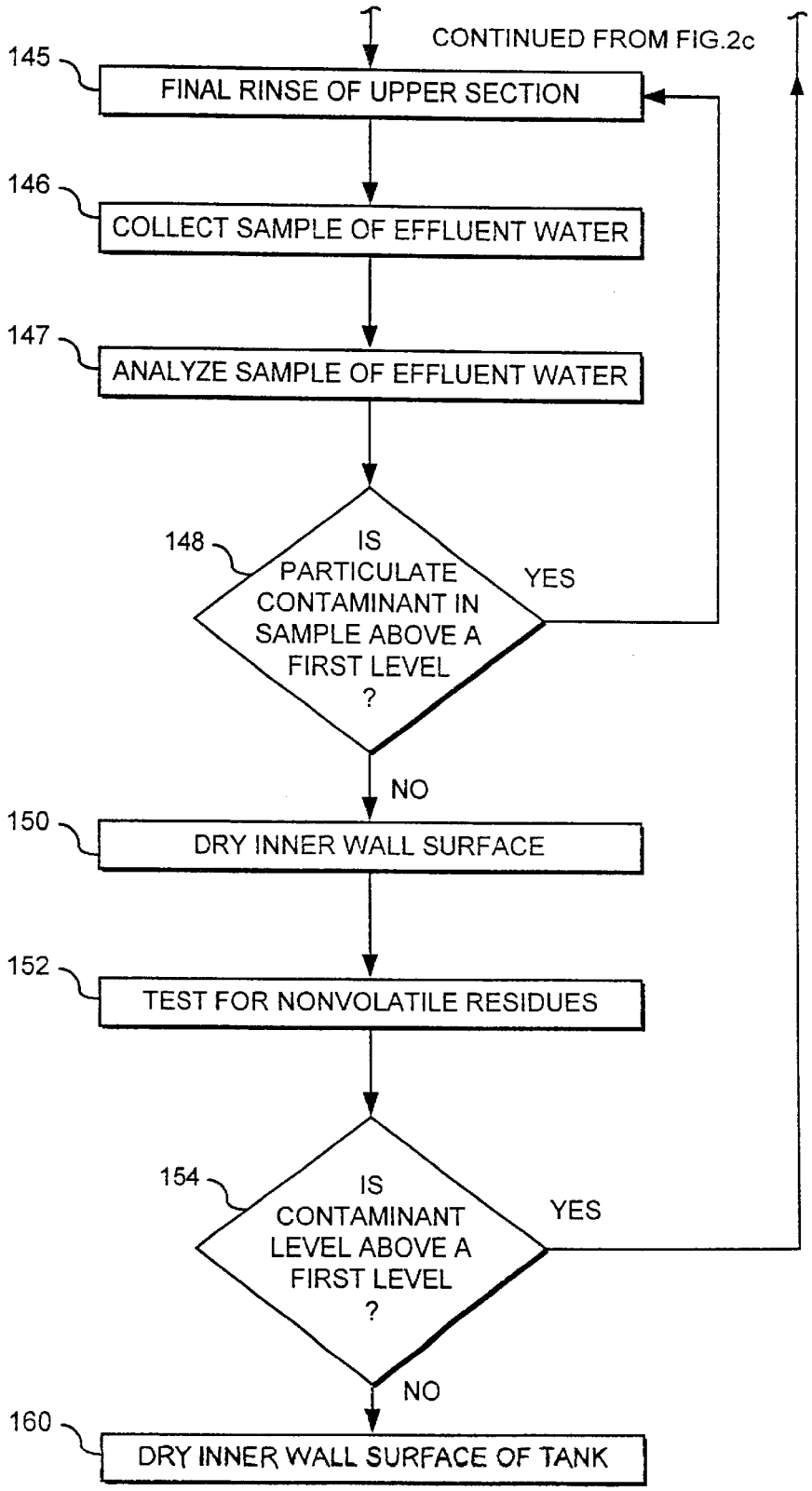

Various methods may be used to analyze a sample of effluent water for particulates, as referenced in step 147 of FIG. 2D. A preferred analysis in the method of the present invention includes filtration of the water sample and visually inspecting the filter (e.g., 1 micron or finer) under the microscope to evaluate the distribution of particles and fibers, and weighing the filter before and after filtration to find the weight of the particles and fibers (the total filterable solids). The distribution of particles and weight in the rinse sample after cleaning minus the distribution of particles and weight of the purified water corresponds to the cleanliness of the inner wall surface. In addition, in the present embodiment, the testing process of steps 134, 142 may include analysis of the effluent deionized water sample for pH, which is an indication of whether the residual aqueous cleaning solution has been sufficiently washed off the inner wall surface; a pH in the range of about 6.5 to about 8.0 is considered adequate to indicate substantial removal of aqueous cleaning solution. If the level of particulate contaminants of the effluent deionized water sample is within acceptable limits, this embodiment of the method further includes the step 150 of drying the inner wall surface of the tank. It should be noted that the purity of water used in the cleaning process, at least for the final rinse step 145, shall be better than the cleanliness required of the tank, as indicated in the above Tables.

Referring to FIG. 2D, the step of testing 152 may follow the step of drying 150 (e.g., using dry air or nitrogen or inert gas) the inner wall surface of the tank after the analysis step 147. This testing may include, for example, the use of an organic cleaning agent, such as Vertrel® MCA which is commercially available from DuPont, and/or swipe tests with Teflon membrane filters. The swipe test is applicable to the liquid oxygen (Lox) tank. The purity of the organic solvent used for the nonvolatile residue analysis shall be better than the cleanliness required of the inner wall surface of the tank being cleaned, as indicated in Table 1 herein. The nonvolative residue solvent shall be applied (e.g., sprayed) on the bottom of the tank (at least 50 square feet). The quantity of solvent shall be determined based on 100 ml/square foot. The internal area (at least 50 square feet) shall be adequately sprayed with this pre-determined quantity of solvent. The step 152 of testing for nonvolatile residues using the solvent Vertrel® MCA, includes the steps of applying (e.g., spraying) about 1 to 2 gallons of this solvent through the outlet sump at the bottom of a vertically oriented tank on the inner surfaces and collecting at least a first sample of the effluent Vertrel® MCA emerging from the effluent drain fixture and analyzing at least the first sample for nonvolatile residues. Acceptable nonvolatile residues depends on the intended use of the system (e.g., see Table 1). If an unacceptable level of such residues is observed in the effluent Vertrel® MCA collected from the effluent drain, for example, then the step 116 of selecting aqueous cleaning solution, steps 120, 122 of applying the aqueous cleaning solution to the lower and upper sections of the inner wall surfaces and the steps 130, 138 of rinsing with the upper and lower sections of the inner wall surface with the water are to be repeated, along with the collecting and analyzing the effluent solution and water steps 124, 126, 132, 134, 140 and 142, and collecting and analyzing samples for contaminants 145, 146 and 147, and drying step 150. In other instances, the testing step 152 includes the steps of wiping selected areas of the inner wall surface with Teflon membrane filters (nonlaminated and nonbonded) and then testing such filters for presence of hydrocarbon contaminants using Fourier transform infrared analysis. When this approach is used, the user reviews the infrared spectrum for absorbance peaks at the CH (hydrocarbon) region near 2930 $CM^{-1}$; if the peaks are within three times of background, the hydrocarbon level is acceptable. Note that it is recommended to perform this test prior to conducting the above-described test using Vertrel® MCA. Again, if an unacceptable level of hydrocarbon contaminants is observed in any of the testing techniques used, the step 116 of selecting cleaning solution, the steps 120 and 122 of applying cleaning solution to the inner wall surface of the tank and the steps 130 and 138 of rinsing the inner wall surface of the tank with the water, along with the steps 124, 126, 132, 134, 140 and 142 of collecting and analyzing effluent samples and step 145 of final rinse, and steps 146 and 147, are to be repeated. In the event acceptable levels of contaminants are achieved, the step 160 drying the inner wall surface of the tank may be conducted. The level of dryness may be determined by system requirements. In this embodiment, the drying steps 150, 160 comprise flowing a gas, such as dry air or gaseous nitrogen, over or against the inner wall surface of the tank. The purity of the dry air or gaseous nitrogen is to be better than the required cleanliness of the tank (e.g., having a distribution and weight of particles and fibers, and hydrocarbons, less than as shown on Tables 1 and 2, 30 degrees Fahrenheit or drier for the drying step 150, and −40 degrees Fahrenheit or drier for the drying step 160, as required).

In the embodiments described above, the cleaning solution utilized in the method of the present invention preferably comprises sodium silicate, sodium tetrafluoroborate and sodium molybdate in concentrations of about 10% sodium silicate, about 1.5% sodium tetrafluoroborate, and about 0.5% sodium molybdate, with about 88% water, by weight. As noted above, this concentration is suitable for use at temperatures between about 65 degrees Fahrenheit and about 75 degrees Fahrenheit, and there is no requirement to heat the cleaning solution. Applying such cleaning solution to the inner wall surfaces at such room temperatures inhibits gelling and drying of the cleaning solution. In this regard, contaminants are less likely to become trapped on the inner wall surface of the tank. Other constituent concentrations may be used, but such adjustments in concentration may require changes in the temperature of the cleaning solution as well as other adjustments in the method as one skilled in the art will appreciate.

While various techniques for applying the aqueous cleaning solution may be used, in a preferred embodiment, the applying steps comprise spraying the cleaning solution with a spraying device, such as a triple nozzle orbital sprayer (not shown). Due to the large volume of launch vehicle propellant tanks, the embodiments described herein contemplate that the spraying device is lowered into the interior of the tank through an access hole or manhole in the top end of the vertically oriented tank. The spraying device may be lowered to allow spraying of the upper section of the inner wall surface, and may be lowered still further to allow spraying of the lower section of the inner wall surface, pursuant to the method of the present invention. While the embodiments herein reference spraying first and second (e.g., upper and lower) sections of the vertically oriented launch vehicle propellant tank, the method of the present invention may be used in connection with precision-cleaning smaller volume tanks or containers, where it is possible to spray the entire tank as one or a single section. Further, for larger volume tanks or when otherwise desirable, the steps of applying and/or rinsing may comprise spraying the cleaning solution and/or water onto a plurality of smaller sections in a sequential process, by appropriately positioning the spraying device. As an example, depending on dimensions of the launch vehicle propellant tanks, a rocket propellant fuel tank may be comprised of two sections and liquid oxygen (Lox) tank may be comprised of five sections. These sections are approximately equidistance from outlet sump to manhole cover.

Figure 3:
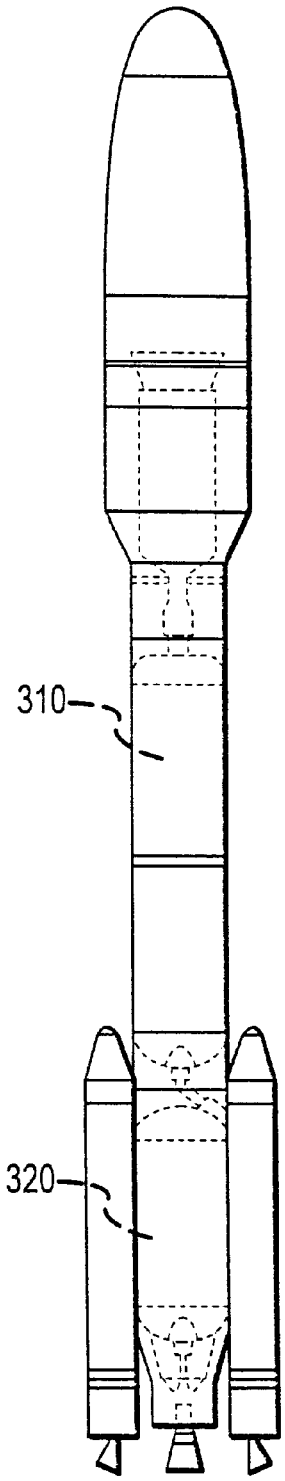
FIG. 3 is a perspective view of a launch vehicle having a liquid oxygen tank and rocket propellant fuel tank.
Figure 4:
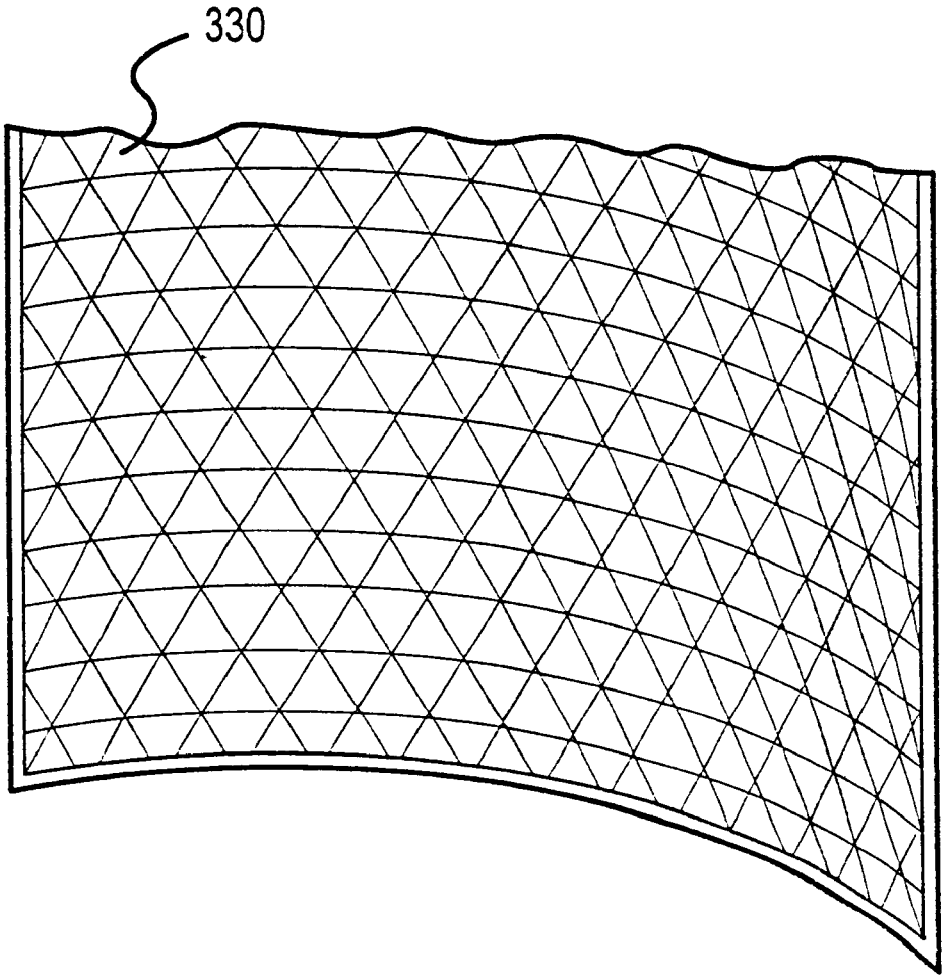
FIG. 4 is a cutaway perspective view of the inner wall surface of the liquid oxygen or rocket propellant tank illustrated in FIG. 3.
Figure 5:
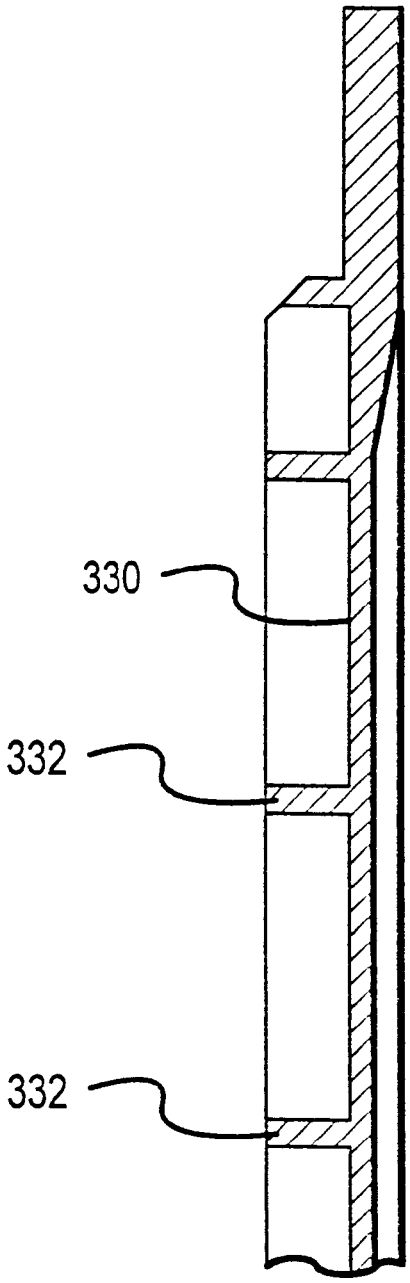
FIG. 5 is a cross-sectional view of a portion of the liquid oxygen or rocket propellant fuel tank.

FIGS. 3, 4 and 5 show a launch vehicle with liquid oxygen and rocket propellant tanks 310, 320, and perspective and cross-sectional views of portions of the inner wall surface 330 of a rocket propellant tank. The liquid oxygen and rocket propellant tanks of a launch vehicle, as depicted in FIG. 3, may be cleaned in accordance with the methods of the present invention, especially since such tanks may have particulate and organic contaminants on their inner wall surface 330 from fabrication of such tanks, and in particular, on the inner wall surface of such tanks. FIG. 4 is a cutaway perspective view of a portion of the inner wall surface 330 of a rocket propellant tank (or liquid oxygen tank), showing the complex isogrid structure of the inner wall surface 330. FIG. 5 is a cross-sectional view of a portion of the inner wall surface 330, with isogrid ridges 332, to which the cleaning method of the present invention is particularly useful.

In the present embodiment, the same orbital sprayer is used for both the water and aqueous cleaning solution. The sprayer is preferably operated at a pressure of about 35 pounds per square inch (PSIG) at the sprayer head with about 55 gallons per minute (GPM). Gear ratio of the sprayer at given GPM and pressure is such that nozzle and head rotates approximately one revolution per minute (RPM). At this pressure and GPM, and given the dimensions of the launch vehicle propellant tanks described above, for example, the step of applying the aqueous cleaning solution by spraying such cleaning solution on the inner wall surface of a section may occur for a period of about 60 minutes to about 70 minutes. Using the same sprayer, the time required at a section for spraying the cleaning solution may be about 30 minutes to about 40 minutes by operating sprayer at 65 PSIG at sprayer head with about 80 GPM which rotates head and nozzle at approximately 2 RPM. As will be appreciated, the spraying time required for various tanks and other structures will be a function of various factors, including, but not limited to, the dimensions of the structures, the nature and degree of contamination, the nature of the inner wall surface, and the capacity and cleaning diameter of the sprayer. The use of a pressure sprayer, combined with the other elements of the embodiment described herein, including the aqueous cleaning solution and washing and rinsing steps, provides significant advantages in cleaning a complex surface like the isogrid surface described above. The method provides a highly effective means of removing hydrocarbon and particulate residues adhering to the corners and ridges of the isogrid surface. Such spraying devices are commercially available from various vendors.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. A method for cleaning an inner wall surface of a tank, the inner wall surface comprising a metal, said method comprising the steps of:

applying an aqueous cleaning solution comprising sodium silicate, sodium tetrafluoroborate, and sodium molybdate to at least a first portion of the inner wall surface and a second portion of the inner wall;

wherein during the applying, the first portion of the inner wall surface is vertically higher than the second portion of the inner wall surface, and the applying comprises first spraying the second portion of the inner wall surface with the aqueous cleaning solution and, after the first spraying, second spraying the first portion of the inner wall surface with the aqueous cleaning solution.

2. The method of claim 1, further comprising, prior to the applying:

washing at least the first portion of the inner wall surface and the second portion of the inner wall surface with rinse water;

wherein, the washing comprises first spraying the first portion of the inner wall surface with the rinse water and, after the first spraying, second spraying the second portion of the inner wall surface with the rinse water.

3. The method of claim 2, wherein the washing comprises spraying the rinse water from a spraying device disposed inside of the tank;

wherein the spraying device is at a first elevation opposite the first portion of the wall surface during the first spraying of the first portion of the inner wall surface with the rinse water and, after the first spraying of the first portion of the inner wall surface with the rinse water, the spraying device is lowered to a second elevation opposite the second portion of the inner wall surface for the second spraying of the second portion of the inner wall surface with the rinse water.

4. The method of claim 1, wherein the aqueous cleaning solution comprises about 10% sodium silicate, about 1.5% sodium tetrafluoroborate, about 0.5% sodium molybdate, and about 88% water, by weight.

5. The method of claim 1, wherein said first portion of the inner wall surface and said second portion of the inner wall surface each comprise an aluminum alloy selected from the group consisting of the 2000, 6000 and 7000 aluminum series.

6. The method of claim 1, wherein the applying comprises spraying the cleaning solution from a spraying device disposed inside of the tank;

wherein the spraying device is at a first elevation opposite the second portion of the wall surface during the first spraying and, after the first spraying, the spraying device is raised to a second elevation opposite the first portion of the inner wall surface for the second spraying.

7. The method of claim 6, wherein during each of the first spraying and the second spraying, the cleaning solution is sprayed from the spraying device at a rate of at least about 55 gallons per minute.

8. The method of claim 7, wherein during each of the first spraying and the second spraying, the spraying device is operated at a pressure of at least about 35 psig.

9. The method of claim 7, wherein the spraying device comprises an orbital sprayer rotating at a rate of from about 1 revolution per minute to about 2 revolutions per minute during each of the first spraying and the second spraying.

10. The method of claim 6, wherein the method further comprises, after the rinsing, drying the inner wall surface.

11. The method of claim 10, wherein the interior of the tank, after the drying, contains:

no more than 1 mg of nonvolatile residue per square foot of internal surface area in the tank;

hydrocarbons at a level no greater than 10 parts per million by volume as methane per liter of the fluid capacity of the tank; and total filterable solids of no greater than 0.1 mg per square foot of internal surface area in the tank.

12. The method of claim 1, further comprising, after the applying, rinsing at least the first and second portions of the inner wall surface with rinse water;

wherein the rinsing comprises first spraying the first portion of the inner wall surface with the rinse water and, after the first spraying, second spraying the second portion of the inner wall surface with the rinse water.

13. The method of claim 12, further comprising the steps of:

sampling and analyzing effluent cleaning solution from the applying to determine at least a level of hydrocarbon contaminants in the effluent cleaning solution; and commencing the rinsing only after the hydrocarbon contaminants in the effluent cleaning solution do not exceed a preselected standard.

14. The method of claim 12, further comprising the steps of:

sampling and analyzing for pH of effluent rinse water from the first spraying the first portion of the inner wall surface with rinse water; and continuing the first spraying at least until the pH of the effluent rinse water is within a range of from about pH 6.5 to about pH 8.

15. The method of claim 12, wherein said rinsing step is commenced within about five minutes after completion of said applying step.

16. The method of claim 12, wherein the rinsing comprises spraying the rinse water from a spraying device disposed inside of the tank;

wherein the spraying device is at a first elevation opposite the first portion of the wall surface during the first spraying of the first portion of the inner wall surface with the rinse water and, after the first spraying of the first portion of the inner wall surface with the rinse water, the spraying device is lowered to a second elevation opposite the second portion of the inner wall surface for the second spraying of the second portion of the inner wall surface with the rinse water.

17. The method of claim 12, wherein the rinse water contains:

total organic carbon of no greater than 1 mg per square foot of internal surface area in the tank; and total filterable solids of no greater than 0.1 mg per square foot of internal surface area in the tank.

18. The method of claim 12, further comprising, after the rinsing, final rinsing, the final rinsing comprising:

spraying a final rinse water on at least the first portion of the inner wall surface; and sampling final rinse water effluent and determining particulate contamination in final rinse water effluent;

wherein the final rinse is continued at least until the particulate contamination in the final rinse water effluent is determined to be no larger than a preselected standard.

19. The method of claim 1, wherein the aqueous cleaning solution is at a temperature between about 65 degrees Fahrenheit and about 75 degrees Fahrenheit during the applying.

20. The method of claim 1, wherein the tank has a capacity of at least approximately 26,000 gallons.

21. The method of claim 1, wherein the tank has a height of at least 32 feet.

22. The method of claim 1, wherein the inner wall surface has an isogrid structure.

23. The method of claim 1, wherein the applying further comprises, after the second spraying, third spraying at least a third portion of the inner wall surface with the cleaning fluid, the third portion of the inner wall surface being vertically higher than the first portion of the inner wall surface.

24. The method of claim 1, wherein each of the first and second spraying last at least about 30 minutes.

25. A method for cleaning a cylindrical tank, having top and bottom ends, and an inner wall surface comprising an aluminum alloy, said method comprising steps of:

verticalizing the tank;

first washing at least a first section of the inner wall surface with a first portion of rinse water;

after the first washing, second washing at least a second section of the inner wall surface located below said first section with a second portion of rinse water;

after the second washing, first applying a first amount of an aqueous cleaning solution comprising sodium silicate, sodium tetrafluoroborate, and sodium molybdate to said second section of the inner wall surface;

after the first applying, second applying a second amount of said aqueous cleaning solution to said first section of the inner wall surface;

after the second applying, first rinsing said first section of the inner wall surface with a third portion of rinse water; and after the first rinsing, second rinsing said second section of the inner wall surface with a fourth portion of water.

26. The method of claim 25, further comprising, following said second applying step, the steps of:

collecting a first sample of said effluent cleaning solution after said second applying step; and analyzing said first sample for hydrocarbon contaminants.

27. The method of claim 26, wherein said first sample of said effluent cleaning solution includes a first level of hydrocarbon contaminants, said method further comprising the step of:

repeating at least said first and second applying steps.

28. The method of claim 25, wherein each of the first rinsing and the second rinsing comprise:

monitoring effluent rinse water for at least pH as an indication of the level of aqueous cleaning water in the effluent rinse water; and wherein the first rising and the second rinsing are each continued at least until the pH of the effluent rinse water is within a range of pH 6.5 to pH 8.

29. The method of claim 25, further comprising, following said second rinsing, the steps of:

third rinsing said first section of the inner wall surface with a fifth portion of rinse water, wherein an effluent rinse water results from said third rinsing with a fifth portion of water;

collecting a sample of said effluent rinse water from said third rinsing with a fifth portion of water;

analyzing said sample of effluent rinse water from said third rinsing with a fifth portion of water to determine at least a level of particulate contaminants;

comparing the level of particulate contaminants with a preselected standard and continuing the third rinsing at least until the level of particulate contaminants is no larger than the preselected standard.

30. The method of claim 29, further comprising, following said step of analyzing said sample of effluent rinse water from said third rinsing with a fifth portion of water, the steps of:

drying said first and second sections of the inner wall surface;

analyzing a bottom area of said second section of the inner wall surface proximate to the bottom end to determine measured nonvolatile residues; and, repeating at least said first applying, said second applying, said first rinsing, said second rinsing, said third rinsing and said drying when the measured nonvolatile residues exceed a preselected standard.

31. The method of claim 30, wherein said analyzing step comprises applying a first amount of a first organic cleaning agent to a portion of said second section and testing effluent organic cleaning agent from said applying the first amount of the first organic cleaning agent draining off said portion for nonvolatile residues.

32. The method of claim 30, wherein said analyzing step comprises at least one swipe test with a Teflon membrane filter and Fourier transform infrared analysis of said Teflon membrane filter following said swipe test.

33. The method of claim 25, wherein said aqueous cleaning solution is comprised of about 10% sodium silicate, about 1.5% sodium tetrafluoroborate, about 0.5% sodium molybdate, and about 88% water, by weight.

34. The method of claim 25, wherein said second applying is commenced no later than about five minutes after said first applying and said first rinsing is commenced no later than about five minutes after said second applying.

35. The method of claim 25, wherein the aluminum allow is selected from the group consisting of 2000 series aluminum alloys, 6000 series aluminum alloys and 7000 series aluminum alloys.

* * * * *

UNITED STATES PATENT AND TRADEMARK OFFICE

CERTIFICATE OF CORRECTION

PATENT NO. : 6,308,720 B1
DATED : October 30, 2001
INVENTOR(S) : Modi

It is certified that error appears in the above-identified patent and that said Letters Patent is hereby corrected as shown below:

Column 3,
Lines 48 and 53, delete the word "acqueous" and insert therefor -- aqueous --;

Column 7,
Lines 38, 39, 46 and 48, delete the word "acqueous" and insert therefor -- aqueous --;

Column 15, claim 28,
Line 22, delete the word "rising" and insert therefor -- rinsing --;

Column 16,
Line 35, delete the word "allow" and insert therefor -- alloy --.

Signed and Sealed this

Twelfth Day of March, 2002

*Attest:*

*Attesting Officer*

JAMES E. ROGAN
*Director of the United States Patent and Trademark Office*